US007082739B2

(12) United States Patent
Guernieri et al.

(10) Patent No.: US 7,082,739 B2
(45) Date of Patent: Aug. 1, 2006

(54) CENTERING AND HOLDING UNIT FOR CAPPING HEAD

(75) Inventors: Daniele Guernieri, Porto Mantovano (IT); Stefano Cavallari, Bologna (IT)

(73) Assignee: Azionaria Costruzioni Macchine Automatiche A.C.M.A. S.p.A., Bologna (IT)

( * ) Notice: Subject to any disclaimer, the term of this patent is extended or adjusted under 35 U.S.C. 154(b) by 0 days.

(21) Appl. No.: 10/491,502

(22) PCT Filed: Jul. 30, 2003

(86) PCT No.: PCT/IB03/03454

§ 371 (c)(1),
(2), (4) Date: Mar. 30, 2004

(87) PCT Pub. No.: WO2004/014777

PCT Pub. Date: Feb. 19, 2004

(65) Prior Publication Data

US 2004/0237470 A1 Dec. 2, 2004

(30) Foreign Application Priority Data

Aug. 5, 2002 (IT) ..... BO2002A0522

(51) Int. Cl.
*B67B 3/20* (2006.01)
*B65B 7/28* (2006.01)

(52) U.S. Cl. ..... 53/367; 53/317

(58) Field of Classification Search ..... 53/306, 53/308, 310–315, 317, 331.5, 367
See application file for complete search history.

(56) References Cited

U.S. PATENT DOCUMENTS

| | | | | |
|---|---|---|---|---|
| 1,912,677 | A * | 6/1933 | Williams | 53/367 |
| 2,925,797 | A * | 2/1960 | Diezel et al. | 53/308 |
| 3,837,141 | A * | 9/1974 | Lorieux | 53/367 |
| 4,773,560 | A * | 9/1988 | Kittscher | 53/490 |
| 6,494,017 | B1 | 12/2002 | McGrath et al. | |
| 2003/0136465 | A1 * | 7/2003 | De Antoni Migliorati et al. | 141/165 |

FOREIGN PATENT DOCUMENTS

| | | | |
|---|---|---|---|
| DE | 1532525 | | 3/1970 |
| DE | 4039434 | | 6/1992 |
| EP | 0559946 | A1 * | 9/1993 |
| JP | 2001139094 | A * | 5/2001 |

* cited by examiner

*Primary Examiner*—Stephen F. Gerrity
(74) *Attorney, Agent, or Firm*—Timothy J. Klima

(57) ABSTRACT

Containers (2) having a threaded neck (3) and a mouth (4) are capped by a unit (1) appearing as a carousel (5) equipped with capping heads caused to advance along a circular path (P) and capable of axial movement toward and away from the containers in such a way that each one can be fitted with a relative cap (11); each capping head of the unit (1) incorporates a gripper (31) furnished with two jaws (30) presenting relative conical surfaces (26), and respective cylindrical surfaces (27) designed to locate against the neck (3) of the container. When the cylindrical surfaces (27) register against the outer surface of the neck (3), the conical surfaces (32) are positioned with the lower edges (28) encroaching on the area compassed by the mouth (4) in such a way that the cap (11) can be gathered and aligned with the neck (3) of the container (2) before being tightened, thereby ensuring a precise fit.

11 Claims, 5 Drawing Sheets

CENTERING AND HOLDING UNIT FOR CAPPING HEAD

This application is the National Phase of International Application PCT/IB03/03454 filed Jul. 30, 2003 which designated the U.S. and that International Application was published under PCT Article 21(2) in English.

TECHNICAL FIELD

The present invention relates to a unit for capping containers.

In particular, the invention relates to a unit such as will apply a cap incorporating a measure cup and drip catcher to the neck of each container.

BACKGROUND ART

Caps incorporating a measure cup and drip catcher are fashioned generally with a grippable portion of substantially cylindrical shape, terminating at the bottom in a screw collar enlarged to a diameter greater than that of the grippable portion and threaded internally in such a way that it can be coupled releasably with the threaded neck of a respective container. The cap also presents a cylindrical tubular element disposed concentrically with the screw collar and smaller in diameter. The cylindrical tubular element is accommodated in part by the cap, to which it is anchored, combining thus with the inside of the grippable portion to provide a cup that can be used to measure out the product in the container. The part of the cylindrical element that projects axially from the cap and beyond the free edge of the screw collar is insertable into the mouth of the container with a rectilinear movement, and the cap thereupon advanced to the point at which the internal thread of the collar can be coupled with the external thread of the neck. The diameter of the tubular element will generally match the diameter presented by the mouth of the container and, accordingly, the insertion step calls for a certain degree of accuracy, obtained by positioning the container and the relative cap in such a way that the mouth and the tubular element are in faultless axial alignment one with another.

Capping units of the type in question generally comprise a main carousel rotatable about a vertical axis and carrying a plurality of capping stations spaced apart at identical angular distances around the axis. Each capping station comprises a capping head equipped with a gripper device designed to close around the collar of the cap, and is capable of axial movement along a second axis toward and away from a position of engagement with a relative container, in which the cap is tightened on the neck by the capping head. The main carousel is supplied with a succession of containers, each presenting a body and a filler mouth, received from a first rotary infeed conveyor by way of a first transfer station, and a succession of caps entering by way of a second station.

During operation, the capping heads orbit about the vertical axis of the carousel, each also moving axially toward the neck of a relative container in such a way as to direct the tubular element into the mouth. The head then describes a controlled rotation about its own axis in such a way as to screw the cap onto the container, whereupon the capped containers are directed onto a second outfeed conveyor by way of a third transfer station.

During the operation of inserting the caps and securing them to the containers, the containers rotate as one with the respective gripper devices about the axis of the carousel, the object being to keep them in the correct capping position, with the mouth aligned substantially beneath the respective capping head. To this end, the containers are accommodated by a plurality of pockets afforded by the base of the carousel.

Among the drawbacks encountered with machines of the type in question is the fact that, although the carousel, the capping heads and the various mechanical and drive components are all suitably dimensioned, it happens that play will develop ultimately in the system due to wear on moving parts, and exact coaxial alignment between the capping head and the mouth of the respective container can be lost. This leads to difficulties in assembling the cap correctly with the neck of the container, causing the capping line to jam and forcing stoppages of the machine. The problem is particularly acute where the caps utilized are of the type incorporating a measure cup and drip catcher.

The object of the present invention is to provide a relatively economical capping unit ensuring long-term reliability, such as will be unaffected by the aforementioned drawbacks and capable of fitting caps to respective containers automatically.

DISCLOSURE OF THE INVENTION

These objects and others besides, which will emerge more clearly from the following specification, are substantially realized in a unit for capping containers comprising a plurality of capping devices movable along a predetermined path toward and away from the containers for fitting caps to respective containers during a passage when each capping device advances along at least one portion of the path accompanied by a relative container, the unit comprising gathering and aligning means, associated and operating in conjunction with each capping device, for gathering and aligning the cap with the neck of the container; wherein said gathering and aligning means comprise at least one first gathering and aligning element comprising a frustoconical surface, converging toward the container, and a cylindrical surface, positionable in direct contact with the container; said frustoconical surface having a lower edge protruding internally of the area compassed by the mouth of the container at least when the cylindrical surface is in a locating position.

The invention will now be described in detail, by way of example, with the aid of the accompanying drawings, in which.

Figure 1:
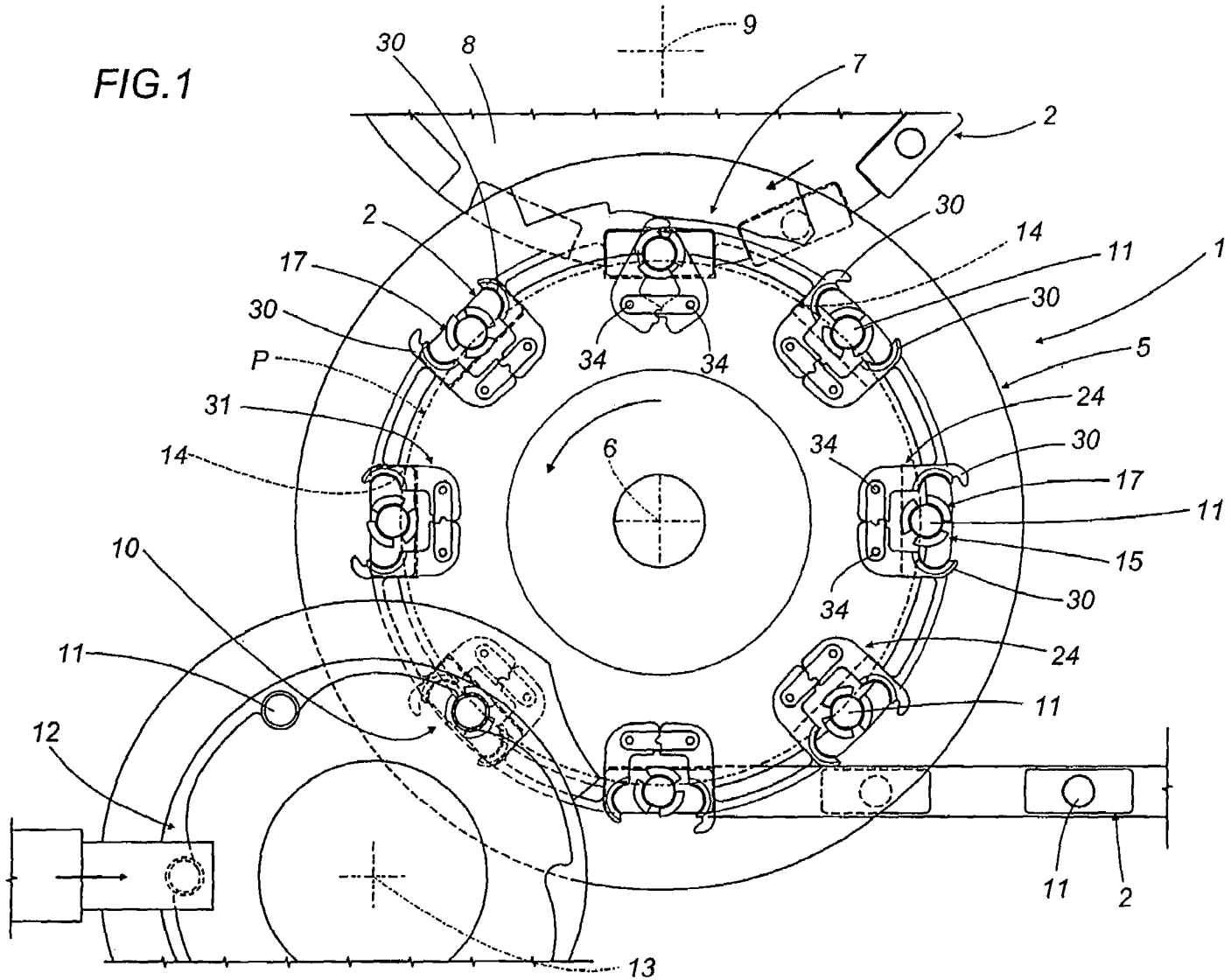
FIG. 1 illustrates a unit for capping containers, viewed schematically and in plan.
Figure 2:
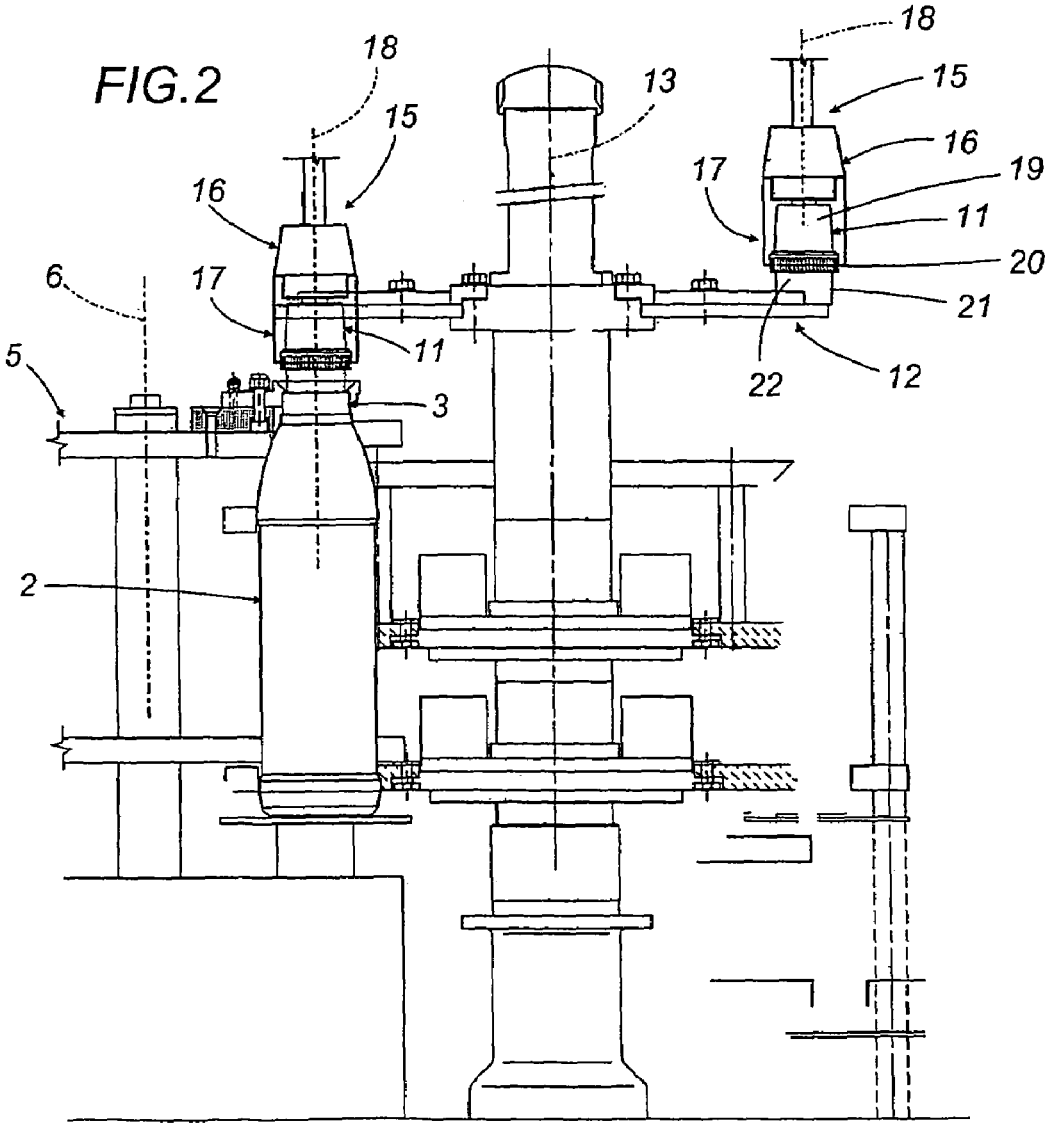
FIG. 2 illustrates a portion of the capping unit in FIG. 1, viewed schematically in a side elevation.
Figure 2A:
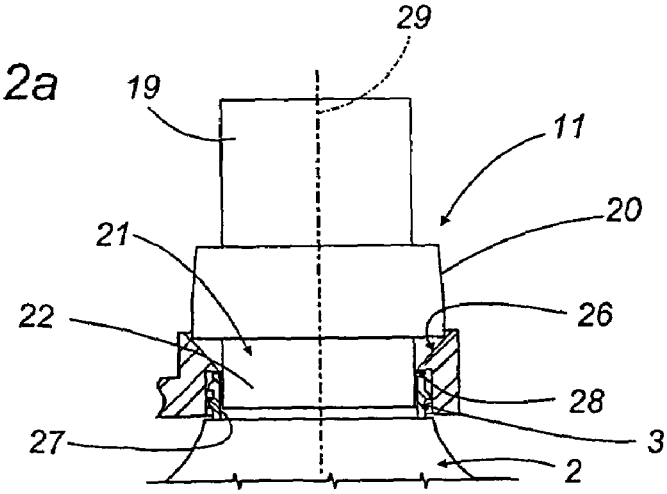
Figure 3:
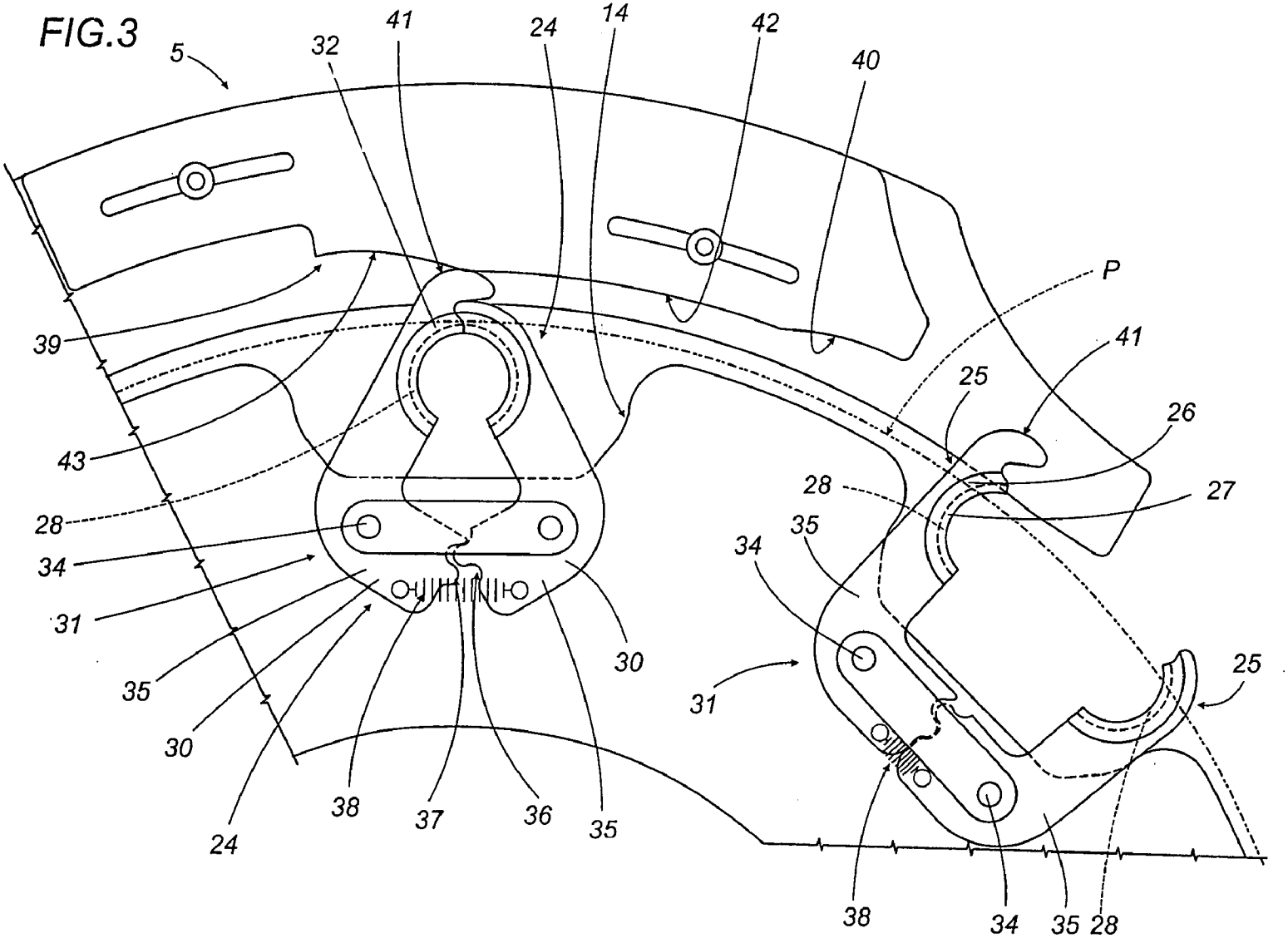
Figure 4:
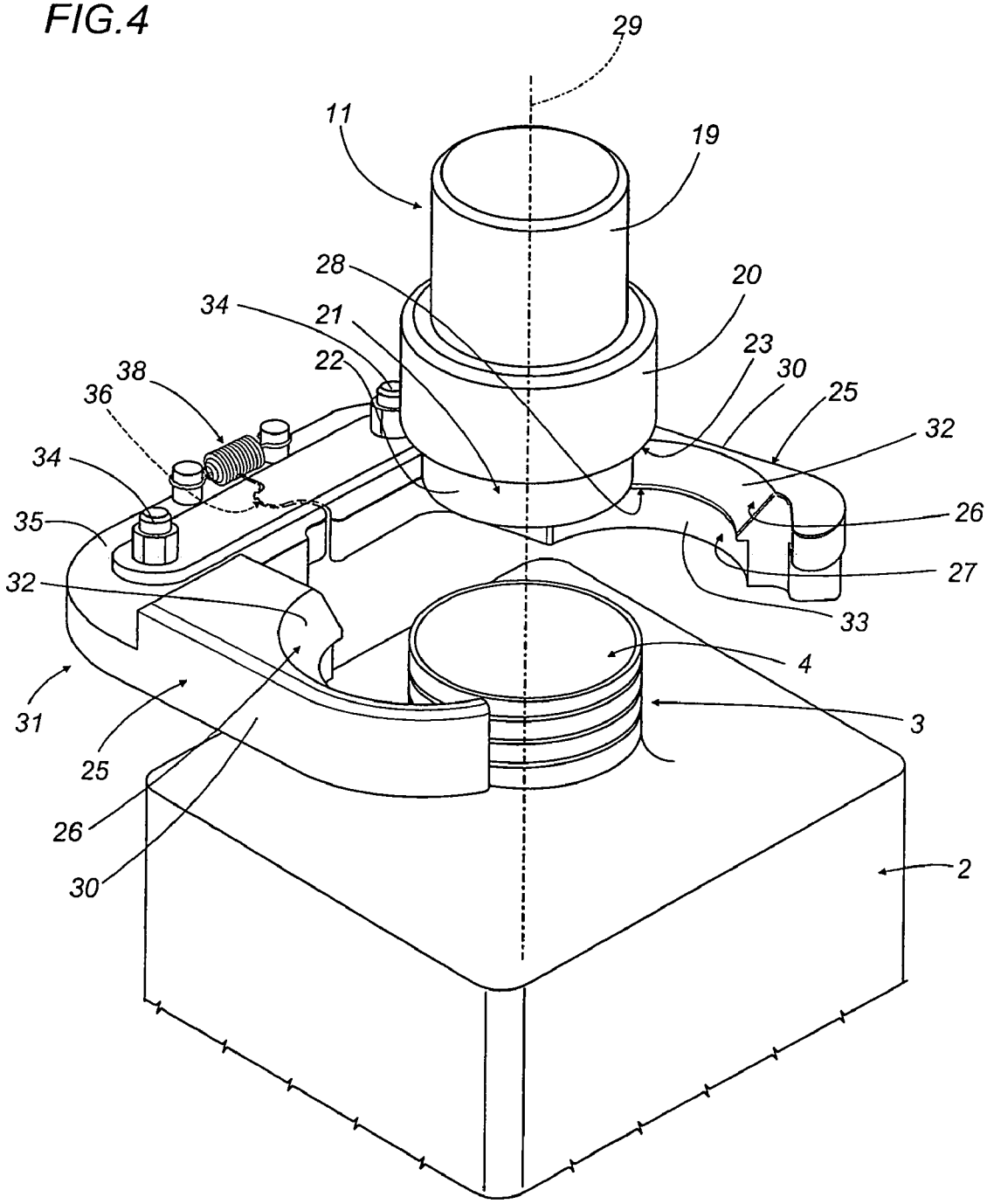
Figure 5:
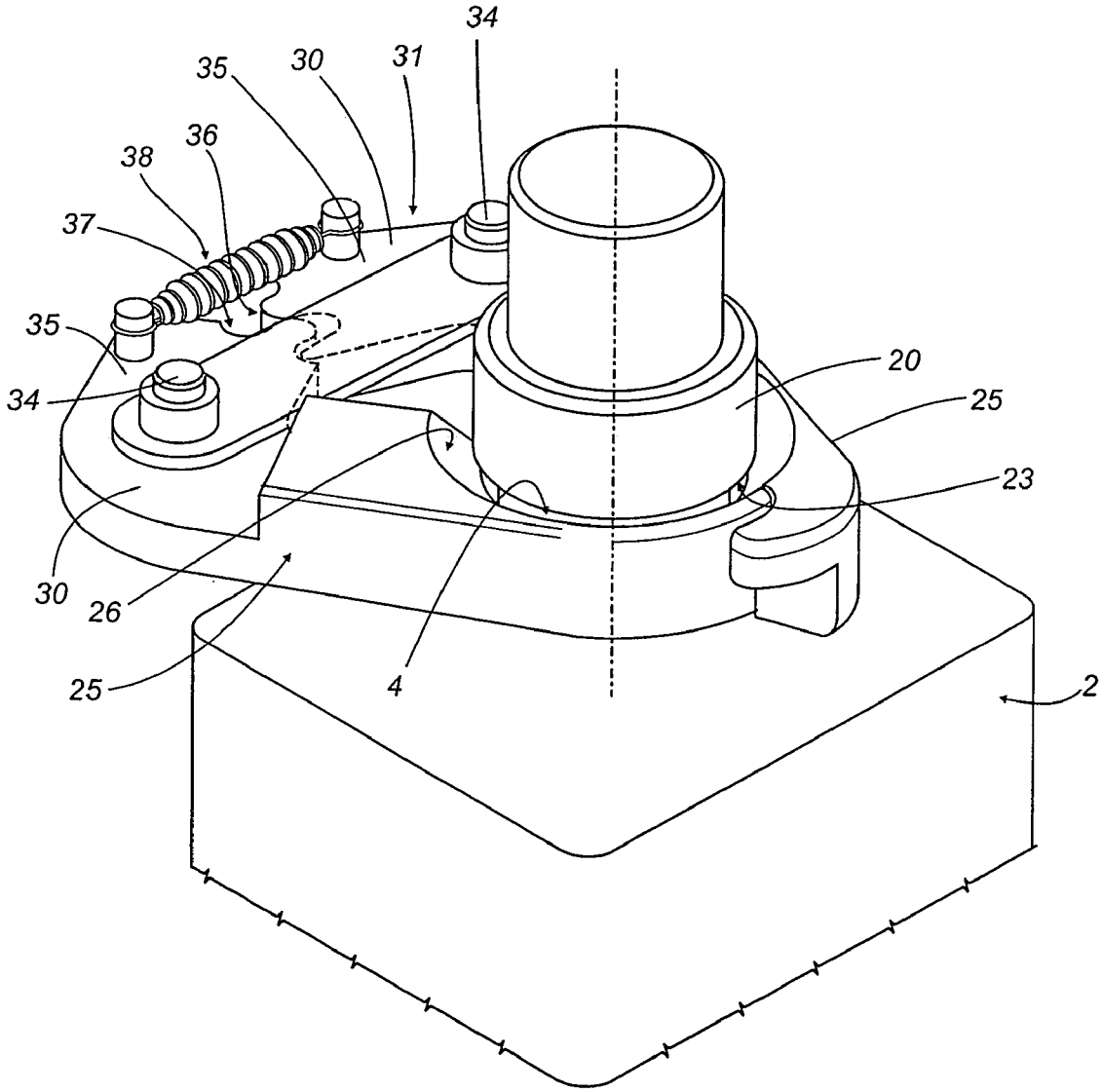

FIG. 2*a* is an enlarged detail of FIG. 2;

FIG. 3 illustrates a detail of the capping unit in FIG. 1, viewed schematically and in plan;

FIGS. 4 and 5 illustrate a detail of the capping unit in FIG. 1, viewed schematically in perspective and shown in two different operating positions.

Referring to FIG. 1 of the drawings, 1 denotes a unit, in its entirety, for capping containers 2 each presenting a neck 3 and a filler mouth 4 (see also FIGS. 2, 2*a*, 4 and 5).

The machine 1 comprises a main carousel 5 rotatable about a vertical axis 6, turning anticlockwise as viewed in FIG. 1, onto which containers 2 are directed singly and in succession by way of a first transfer station 7, from a first rotary infeed conveyor 8.

The infeed conveyor 8 is rotatable about an axis 9 parallel to the vertical axis 6 of the carousel, turning clockwise as viewed in FIG. 1, taking up containers 2 singly and in succession from a respective infeed station not shown in the drawings. The carousel 5 also presents a second infeed station 10 to which caps 11 are supplied singly and in succession by a second rotary conveyor 12 rotatable about a respective axis 13 parallel to the axis 6 of the carousel and turning clockwise as viewed in FIG. 1.

The carousel 5 is positioned and shaped in such a way as to support the containers 2 internally of respective radial pockets 14 open on the outward facing side and equispaced around the periphery, and carries a plurality of capping devices (FIG. 2) likewise equispaced angularly around the periphery.

Each of the capping devices 15, which are of conventional type and not illustrated in their entirety, comprises a capping head 16 of conventional type (FIG. 2), not illustrated in detail, equipped with a gripper device 17 by which the cap 11 can be clamped; the gripper device 17 is also indicated schematically in FIG. 1.

In addition, each capping head 16 is capable of axial movement along a respective axis 18 extending parallel to the axis 6 of the carousel 5, generated cyclically toward and away from a position of engagement with a relative container 2, in which the cap 11 is applied to the neck 3 of the selfsame container 2.

As discernible from FIGS. 2, 2*a*, 4 and 5, the single cap 11 is of the type having a measure cup and drip catcher and comprises a grippable portion 19, of substantially cylindrical appearance as a rule, terminating at the bottom in a screw collar 20 of which the diameter is greater than the diameter of the grippable portion 19.

The collar 20 is threaded internally in such a way that it can be coupled releasably with the threaded neck 3 of a respective container 2. Also forming part of the cap 11 is a cylindrical tubular element 21 disposed concentrically with the screw collar 20, of which the diameter is smaller than the diameter of the selfsame collar 20. The cylindrical tubular element 21 is accommodated in part by the cap 11, to which it is fixed in such a way as to combine with the inside of the grippable portion 19 in providing the aforementioned cup that can be used to measure out the product in the container 2.

The portion 22 of the cylindrical element 21 that projects axially from the cap 11 and beyond the free edge 23 of the screw collar 20 is insertable into the mouth 4 of the container 2 with a rectilinear movement, whereupon the cap will be advanced to the point at which the internal thread of the collar 20 can be coupled with the external thread of the neck 3 by the action of the respective capping head 16.

In general, the diameter of the tubular element 21 will match the internal diameter of the mouth 4, with a small clearance allowed.

During the rotation of the carousel 5, the capping heads 16 and the relative gripper devices 17 revolve around the axis 6 of rotation of the carousel 5 together with the containers 2 positioned in the pockets 14, following a predetermined feed path P.

As discernible from FIGS. 1, 2 and 3, the carousel 5 comprises a set of gathering and alignment means denoted 24 in their entirety, associated with each capping device 15 and therefore with each gripper device 17, such as will provide a positional reference for the cap 11 when directed toward the mouth 4 of the container by the capping head 16 and ultimately align the cap 11 with the mouth 4, thereby eliminating any possible errors of alignment attributable to wear on the moving parts of the carousel 5.

In particular, referring to FIGS. 4 and 5, the gathering and alignment means 24 comprise two gathering and aligning elements 25 each affording a first chute-like surface 26 angled convergently toward a relative container 2, and a second locating surface 27 designed to register against a part of the container 2.

In particular, the second surface 27 is intended to locate against the externally threaded surface of the neck 3.

Referring to FIGS. 2*a*, 4 and 5, when the two locating surfaces 27 register against the neck 3, the lower edge 28 of the first chute-like surface 26 lies within the area compassed by the mouth 4 of the container.

In effect, the locating surface 27 is positioned immediately beneath the chute-like surface 26 and distanced farther from the axis 29 of the container neck 3 than the lower edge 28 of the chute-like surface 26, which conversely encroaches on the area compassed by the mouth 4 of the neck 3.

In greater detail, the gathering and aligning elements 25 function as the jaws 30 of a gripper 31 by which the cap 11 and the neck 3 of the relative container are gathered, restrained and aligned. The two jaws 30 are capable of movement between a spread position (FIG. 4), allowing a container 2 to be inserted into the relative pocket 14 and aligned with the relative capping head 15, and a closed position in which the jaws 30 are in mutual contact, with the respective locating surfaces 27 against the neck 3 on either side, and the lower edges 28 of the chute-like surfaces 26 occupying the space compassed by the mouth 4 of the neck 3, so that the cap 11 can be gathered and aligned with the neck 3.

More exactly, the aforementioned first chute-like surface 26 of each jaw 30 consists in a frustoconical segment 32, and the second locating surface 27 consists in a cylindrical segment 33.

The two jaws 30 are mounted to respective pivots 34 and comprise respective arms 35 furnished with mechanical connection means 36. The means 36 in question are embodied as a pair of toothed sectors 37 designed to mesh one with another in such a way that a movement of one jaw 30 will cause both of the jaws to operate in concert.

In addition, the two jaws 30 are interconnected by an elastic element such as a coil spring 38, by which they are biased toward the spread position.

Observing FIG. 5, it will be seen that when the jaws 30 are in the closed position, the step of gathering the cap 11 and aligning it with the neck 3 is facilitated by the fact that the frustoconical segments 32 and cylindrical segments 33 of the first and second surfaces are brought together to form a continuous frustoconical surface and a continuous cylindrical surface, with the exception of a gap presented by the part of the gripper 31 nearer the connection means 36.

As discernible from FIGS. 1 and 3, one of the jaws 30 interacts with a cam profile 39 extending along the feed path P. In particular, the profile 39 presents three segments, arranged in succession and consisting in: a first closing segment 40 engaged slidably by the heel 41 of the jaw 30 lying upstream relative to the direction of the rotation of the carousel 5, in such a way that the jaws 30 can be rotated into the closed position through the agency of the toothed sectors 37 (FIG. 5); a second segment 42 along which the jaws 30 of the gripper 31 are maintained in the closed position; and a third segment 43 along which the jaws 30 are returned to the spread position.

Once the jaws 30 are in the closed position, the cap 11 is directed toward the container 2 by the relative capping head 16 and, in the event of there being a measure of misalignment between the cap 11 and the neck 3, the bottom edge of the tubular element 21 presented by the cap 11 will slide against the frustoconical surfaces 26 of the jaws 30 and slip easily into the mouth 4 of the neck 3. Once the tubular element 21 has entered the mouth 4 of the container a given distance, the rotation of the carousel 5 will bring the aforementioned heel 41 of the jaw 30 onto the third segment 43 of the cam profile 39 allowing the gripper 31 to open through the agency of the two toothed sectors 37. With the jaws 30 spread, the capping head 16 continues its descent toward the container 2 to the point at which the screw collar 20 locates over the neck 3. Thereafter, the gripper 17 of the capping head 16 will rotate about its axis 18 to tighten the cap 11 on the neck 3 of the container.

The invention claimed is:

1. A unit for capping containers with a neck and filler mouth, comprising a plurality of capping devices movable along a predetermined path toward and away from the containers for fitting caps to respective containers during a passage when each capping device advances along at least one portion of the path accompanied by a relative container, the unit comprising gathering and aligning means, associated and operating in conjunction with each capping device, for gathering and aligning the cap with the neck of the container; wherein said gathering and aligning means comprise at least one first gathering and aligning element comprising a frustoconical surface, converging toward the container, and a cylindrical surface, positionable in direct contact with the container; said frustoconical surface having a lower edge protruding internally of the area compassed by the mouth of the container at least when the cylindrical surface is in a locating position.

2. A unit as in claim 1, wherein said gathering and aligning means comprise two gathering and aligning elements movable between a spread position, distanced one from the other and allowing a container to be positioned in alignment with a relative capping device, and a closed position in which the cap is gathered and aligned with the neck of the container.

3. A unit as in claim 2, wherein the cylindrical surface is positioned beneath the frustoconical surface and is distanced farther from the container neck than the lower edge of the surface.

4. A unit as in claim 2, wherein the gathering and aligning elements constitute two jaws of a gripper gathering and clamping the cap and the neck of a respective container and for aligning one with another.

5. A unit as in claim 4, wherein the two jaws are mounted to respective pivots and comprise respective arms furnished with mechanical connection means for interacting in such a way that a movement of one jaw will have the effect of operating both jaws.

6. A unit as in claim 5, wherein the two jaws are interconnected by spring means for biasing the gathering and aligning elements toward the spread position.

7. A unit as in claim 4, wherein the frustoconical surface and the cylindrical surface lie respectively contiguous one to another when the two jaws are in closed position, for gathering and aligning the cap with the neck of the container.

8. A unit as in claim 4, wherein at least one of the jaws interacts with a cam profile extending along the feed path.

9. A unit for capping containers with a neck and filler mouth, comprising a plurality of capping devices movable along a predetermined path toward and away from the containers for fitting caps to respective containers during a passage when each capping device advances along at least one portion of said path accompanied by a relative container, the unit comprising gathering and aligning means, associated and operating in conjunction with each capping device, for gathering and aligning the cap with the neck of the container; wherein said gathering and aligning means comprise two gathering and aligning elements each comprising a first chute-like surface angled convergently toward the container and a second locating surface positionable in direct contact with the container; each first chute-like surface presenting a lower edge positionable internally of the area compassed by the mouth of the container at least when the second surface is in the locating position; the locating surface being placed beneath the chute-like surface and being distanced farther from the container neck than the lower edge of the chute-like surface.

10. A unit as in claim 9, wherein each first chute-like surface presented by each of the two gathering and aligning elements is a frustoconical surface, and the second locating surface is a cylindrical surface.

11. A unit as in claim 10, wherein the frustoconical surface and the cylindrical surface lie respectively contiguous one to another when the two jaws are in closed position for gathering and aligning the cap with the neck of the container.

* * * * *